United States Patent [19]

Hoffmann

[11] 4,425,866

[45] Jan. 17, 1984

[54] MACHINE AND METHOD FOR COATING PLASTIC CONTAINERS

[75] Inventor: Wolfgang Hoffmann, Modesto, Calif.

[73] Assignee: B & H Manufacturing Company, Inc., Ceres, Calif.

[21] Appl. No.: 315,003

[22] Filed: Oct. 26, 1981

Related U.S. Application Data

[63] Continuation-in-part of Ser. No. 306,483, Sep. 28, 1981, abandoned.

[51] Int. Cl.[3] ..... B05C 13/02

[52] U.S. Cl. ..... 118/58; 118/106; 118/107; 118/109; 118/210; 118/230; 118/232; 118/244

[58] Field of Search ..... 427/240; 118/230, 107, 118/106, 232, 244, 500, 58, 109, 210

[56] References Cited

U.S. PATENT DOCUMENTS

| | | | |
|---|---|---|---|
| 2,590,186 | 3/1952 | Land | 118/106 |
| 2,800,872 | 7/1957 | Remington et al. | 118/230 |
| 2,977,925 | 4/1961 | Norton | 118/230 |
| 3,049,441 | 8/1962 | Huang | 118/106 |
| 3,735,732 | 5/1973 | Van Der Schoot | 118/230 |
| 4,077,355 | 3/1978 | Miller | 118/230 |
| 4,089,294 | 5/1978 | Lasiewicz et-al. | 118/230 |

*Primary Examiner*—Norman Morgenstern
*Assistant Examiner*—Janyce A. Bell
*Attorney, Agent, or Firm*—Edward B. Gregg

[57] ABSTRACT

Machine and method for applying liquid coatings to cylindrical articles such as plastic continues, in which each article during movement by a rotary transport is caused to spin about its cylindrical axis and a liquid coating is applied to the cylindrical surface of the spinning container. A wiper spreads the coating uniformly and a drier dries the coating. The ratio of orbital movement of the containers and the rate and direction of spin of the containers may be adjusted and controlled.

10 Claims, 8 Drawing Figures

MACHINE AND METHOD FOR COATING PLASTIC CONTAINERS

This application is a continuation-in-part of my copending application filed Sept. 28, 1981, Ser. No. 306,483, now abandoned, entitled "MACHINE AND METHOD FOR COATING PLASTIC CONTAINERS".

This invention relates to a machine and to a method of applying a protective coating to plastic containers.

Plastic containers for a variety of liquid commodities including dairy products, soft drink beverages, etc. are packaged in plastic containers made of polyethylene terephthalate, commonly known as PET containers. By reason of the process of making these containers by blow molding, the body of the container is relatively thin compared to the shoulder and neck and to the bottom portion of the container. The thinness of the body wall coupled with the nature of PET creates a difficulty in that the thin container walls are pervious to oxygen which causes some degree of degradation of the contents. Also, in the case of carbonated beverages carbon dioxide is lost by diffusion through the thin walls.

It is common to apply a plastic coating to the body of the container to render the wall impervious. One method of doing this is to provide a preformed film of the plastic material, apply it to the container and heat seal it. This, however, is an expensive operation.

It is an object of the present invention to provide an improved machine and method for applying a plastic coating to such containers.

It is a further and particular object of the invention to provide an improved machine and method whereby a liquid coating of suitable material such as saran can be applied to a blow molded container such as a PET container evenly and to the desired thickness and such operation can be carried out economically.

The above and other objects of the invention will be apparent from the ensuing description and the appended claims.

One embodiment of the invention is shown by way of example in the accompanying drawings, in which.

Figure 1:
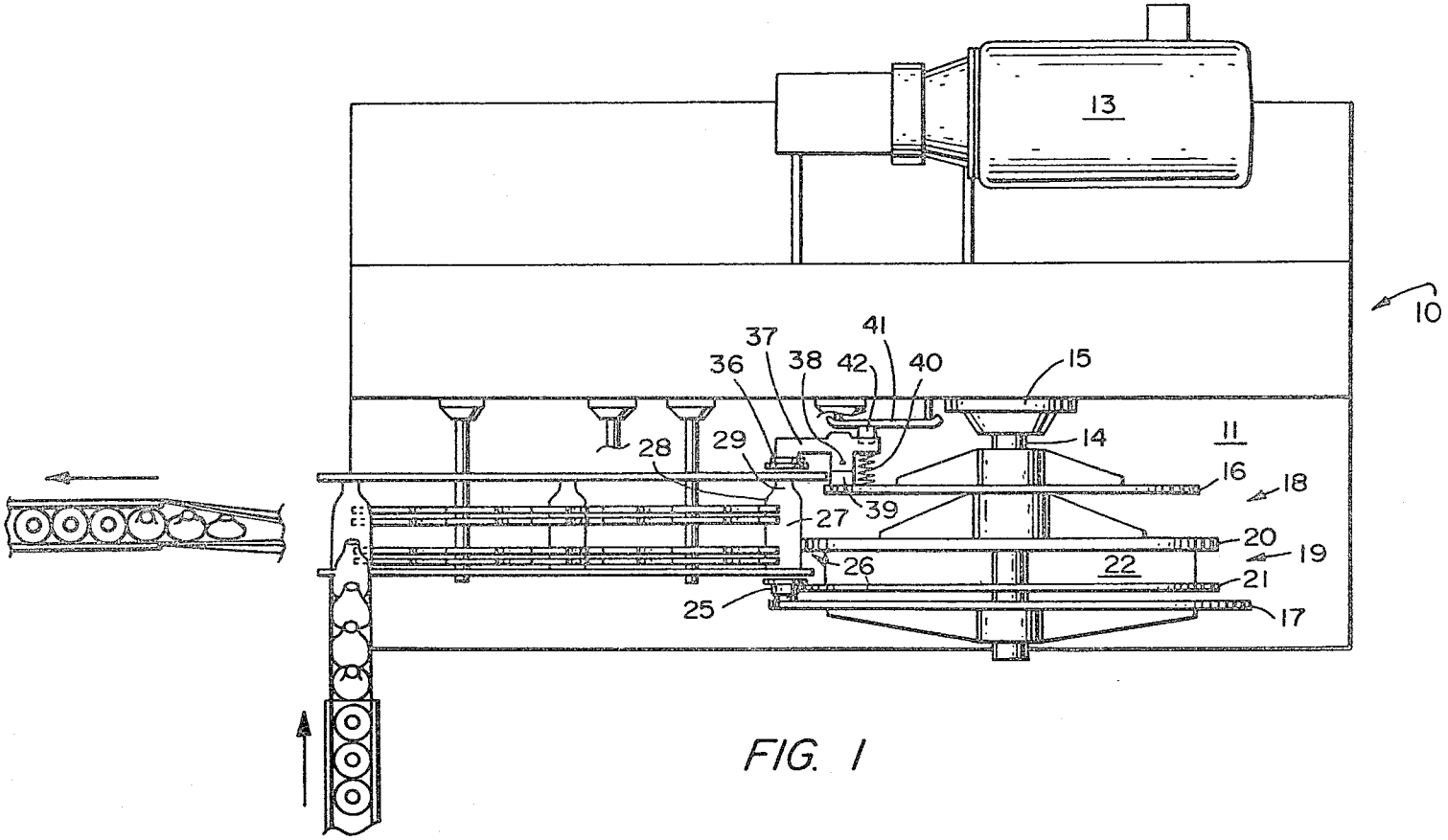
FIG. 1 is a top plan view of the machine.
Figure 2:
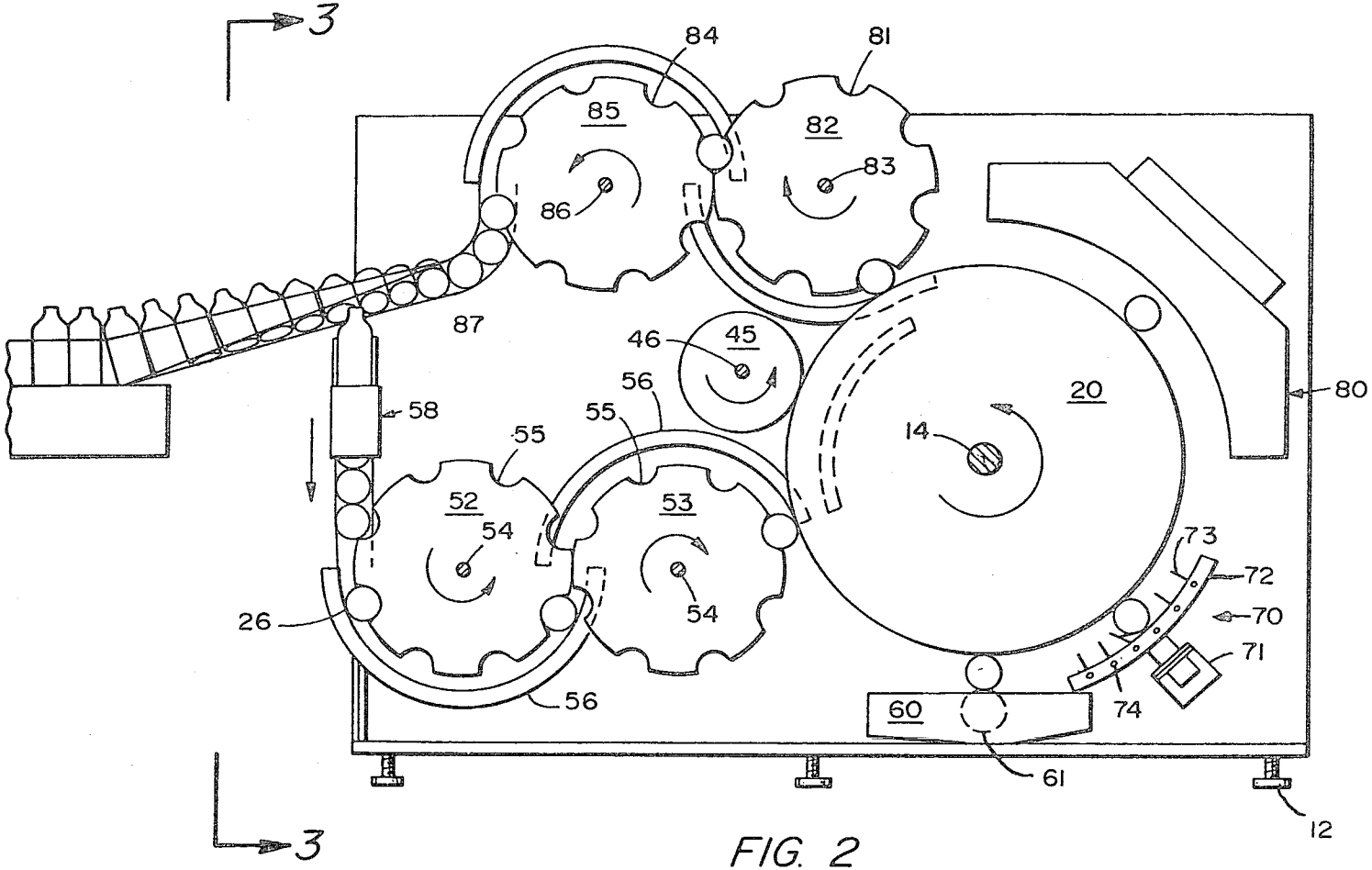
FIG. 2 is a side elevational view of the machine.
Figure 3:
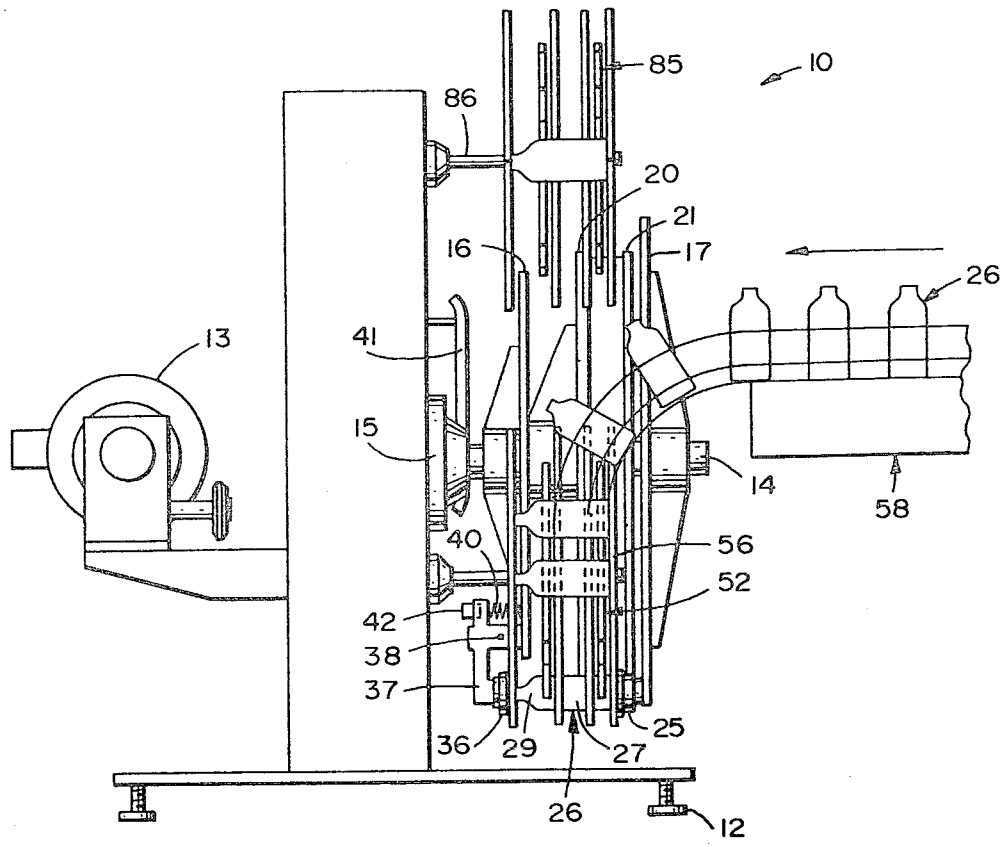
FIG. 3 is an end view as seen along the line 3—3 of FIG. 1.

Referring now to FIGS. 1, 2 and 3 of the drawings, the machine is generally designated by the reference numeral 10 and it comprises a frame 11 supported by adjustable bolts or screws 12. A drive motor 13 (see FIG. 3) is provided which drives a shaft 14 carried by a bearing 15. Affixed to the shaft 14 are two plates 16 and 17 which provide a rotary container transport 18. Between these plates is a chuck drive member 19 comprising a first drive disc 20 and a second drive disc 21, the two being connected by a hub 22.

The disc or plate 17 supports a number of chucks 25, only one of which is shown, there being as many such chucks as is desired. These chucks are freely rotating and each is shaped to fit the bottom of a container 26, which represents a plastic PET container of the type described above, such container having a body portion 27, a shoulder 28 and a crown 29.

The upper plate or disc 16 supports chucks 36, one of which is shown, there being one such chuck for each of the lower chucks 25. Each chuck 36 is adapted to seat against the crown of the container and to clamp a container between the two chucks. Each chuck 36 is carried by a bracket 37 pivoted at 38 on a bracket 39. A spring 40 urges the bracket 37 and with it the chuck 36 in counterclockwise direction as viewed in FIG. 1. That is to say the spring 40 acts normally to clamp a container 26 between the lower chuck 25 and the upper chuck 36. A cam 41 is provided and the bracket 37 is provided with a cam follower 42. During each revolution of the container transport 18 an upper chuck 36 is caused to clamp a container until, at a pickup point and after the coating operation has been completed, the cam 41 will rock the bracket 37 in clockwise direction to release the coated container at a delivery point and to permit insertion of another container.

There is provided, as shown in FIG. 2, a drive wheel 45 fixed to a shaft 46, such shaft being rotated by a variable speed, reversible electric motor (not shown). As will be seen from FIG. 2, the drive wheel 45 bears against the disc 20 and causes it to rotate. This, of course, will cause rotation of the disc 21. The disc 21 bears against the lower chucks 25 and causes them to spin about their individual axes as they rotate about shaft 14 with the transport 18. The purpose and function of this spinning motion are explained below. (FIG. 2 is a section taken through shaft 14 to show disc 20.)

As shown in FIG. 2, there are two infeed star wheels 52 and 53, each fixed to a shaft 54 and provided with pockets 55 to receive to containers 26. Also provided are guards 56. Containers come in through a guide way 58 and are supplied one by one by the star wheels to the container transport 18. As is also shown in FIG. 2, there is a tank or vessel 60 containing an applicator roller 61. The tank contains a supply of coating liquid material such as a solution of saran in a volatile solvent which is applied to the containers as they pass by.

A wiper assembly 70 is provided which is mounted on a bracket 71 and has a curved support 72 from which project wiper blades 73. The blades may be made of thin metal such as steel or of plastic such as polypropylene and preferably they are coated with an absorbent material such as cotton. They are pivotally mounted at 74. As each container passes by the wiper assembly, the blades, which are spring biased so as normally to project radially inwardly, are folded over by the container. The blades then spring back to their normal radial positions. The wipers in this embodiment and in the embodiments shown in FIGS. 4 to 7 serve to wipe excess coating material from the containers and to spread the coating material onto the container.

Then each container, with a coating of saran material evenly applied to the body, passes by a pneumatic drier 80 supplied with air which may be dessicated and/or which may be heated as necessary to dry the coating by evaporating the solvent. Each of the containers is then released by the respective upper chuck 36 as described above. It is picked up by a pocket 81 of a star wheel 82 affixed to a shaft 83 and in turn is transported to a pocket 84 of a star wheel 85 fixed to a shaft 86. Each container is then delivered to a cage type of guide 87 which is of known construction and serves also to rotate each container from the horizontal position to the erect perpendicular position shown.

Reverting now to the function of the wheel 45 and the discs 20 and 21, it will be apparent that by controlling the speed of the drive wheel 45 each container can be made to spin as fast or as slowly as desired as it passes by the applicator roller 61, the wiper 70 and the drier 80. The containers may be rotated in clockwise direction as viewed in FIG. 2 or in counterclockwise direction depending upon the direction of motion of the variable speed, reversible motor drive.

By adjusting the speed at which each container spins as it passes by the applicator roller 61 in its orbit about the axis of shaft 14 and by controlling the direction of spin, the area of the body 27 which is coated and the thickness of coating can be controlled.

This feature is significant and important for the following reasons, among others: It is desirable to apply a uniform coating to the body of each of the containers, such coating being of adequate thickness to render the body impervious to air but not overly thick so as to waste material or to provide an overly thick and unsightly coating which might also be subject to scratching, denting, etc. By the simple expedient of adjusting the speed and/or direction of rotation of the drive disc 45, fine adjustments can be made during operation of the machine without stopping it or slowing it down. As will become apparent from the description of other Figures below, other control features are also provided.

Figure 4:
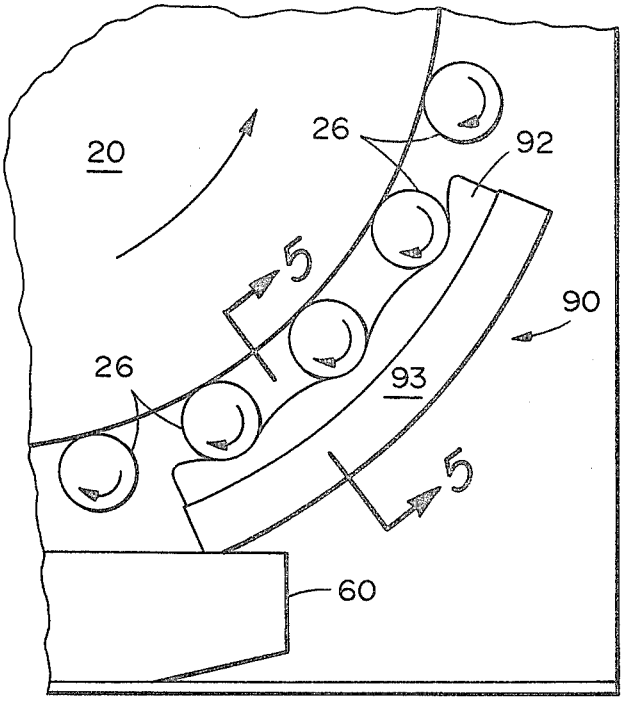
FIG. 4 is a fragmentary view in side elevation of the machine showing a modified wiper for wiping and spreading plastic material on the containers.
Figure 5:
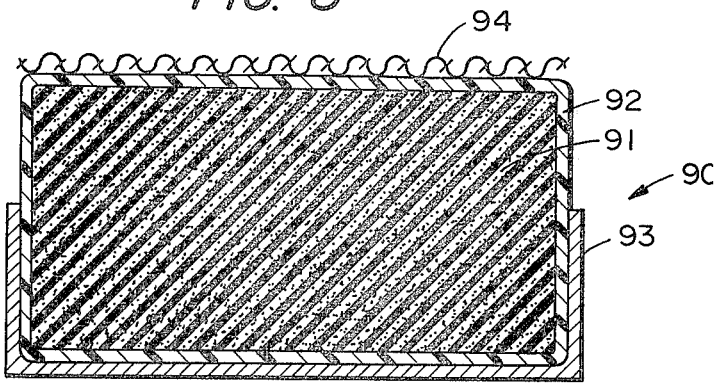
FIG. 5 is a view in cross section along the line 5—5 of FIG. 3, on a larger scale than FIG. 3, showing the construction of the wiper.

Referring now to FIGS. 4 and 5, a wiper 90 is shown which includes a sponge body 91 covered by an impervious material 92 such as Teflon and held in a holder 93. The upper surface of the wiper is covered by an absorbent material 94, e.g. cotton gauze. The wiper has an arcuate shape which is concentric to the disc 20 and is spaced from it a distance somewhat less than the diameter of the containers 26 whereby the sponge 91 is compressed. The compression ensures firm, uniform contact and pressure to accomplish the desired wiping.

Figure 6:
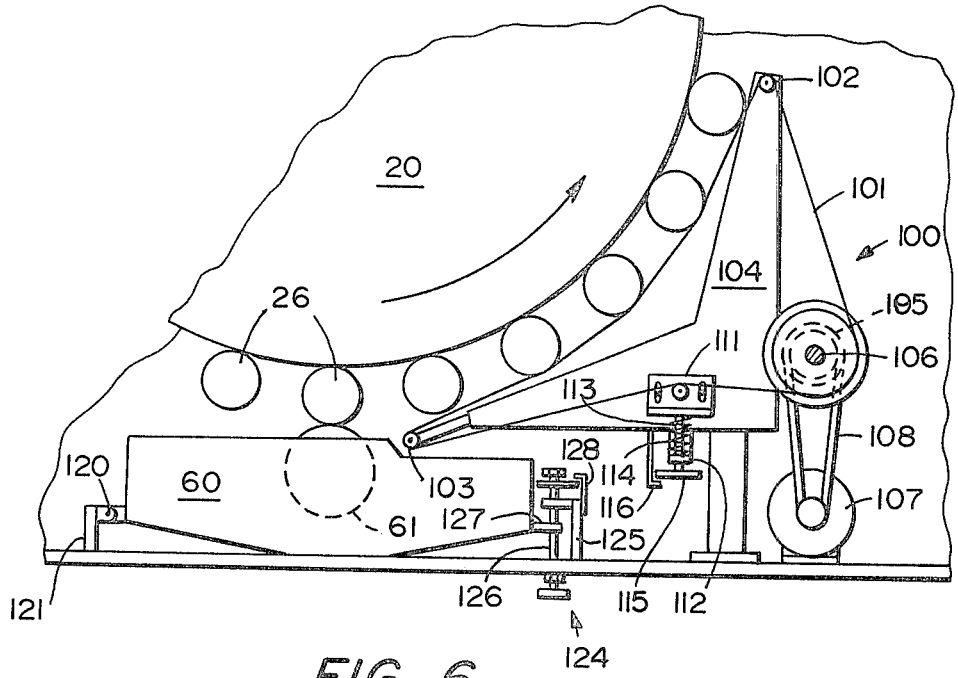
FIG. 6 is a view similar to that in FIG. 4 showing another, and preferred wiper.

Referring now to FIG. 6, a wiper assembly 100 is shown which includes a continuous loop 101 of wiper material. This may be cotton gauze overlying a strip of Teflon. This loop is supported by small rollers 102 and 103 which are mounted on a bracket 104 and by a pulley 105 carried by a shaft 106 mounted on the bracket 104. The pulley 106 and with it the loop 101 are driven by a motor 107 and belt 108. The motor 107 may operate continuously or intermittently to advance the loop 101 to present fresh segments to the containers. (The excess coating material drains into vessel 60 in the embodiments of all of the Figures.)

The tension on loop 101 can be adjusted by a tensioning device which includes a bracket 111 which is slidably mounted on bracket 104 and a bracket 112 which is fixed and through which a screw 113 is threaded to compress a spring 114. By turning screw 113 one way or the other the compression of spring 114, hence the tension of loop 101, can be adjusted. A pointer 115 and a calibrated scale 116 can be used to measure the tension of loop 101. This tension may be adjusted from time to time to control the thickness of coating.

The vessel 60 is pivoted at 120 on a bracket 121 so that it can be tilted more or less. This tilting adjusts the clearance between applicator roller 61 and the containers 26. This in turn contributes, along with the orbital velocity and the rate and direction of spin of the containers, and along with the viscosity and surface tension and wetting characteristics of the materials, to control of the thickness of coatings applied to the containers. An adjustment assembly 124 is provided including a bracket 125, a screw 126 threaded through a bracket 127 on the vessel 60 and through bracket 125 and a gauge 127, which can be calibrated to measure the clearance of the roller 61 and the containers.

Figure 7:
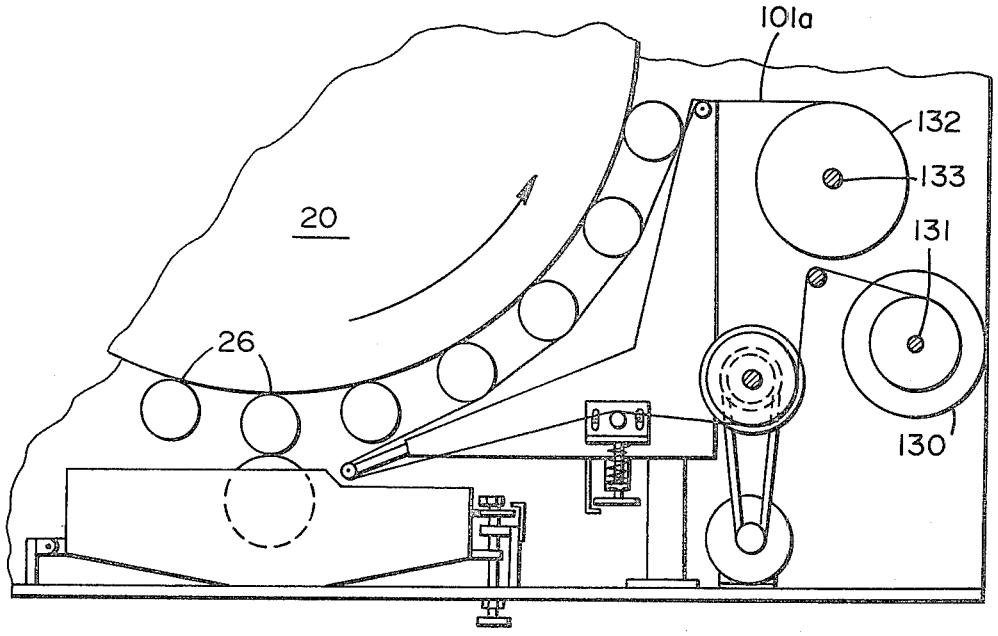
FIG. 7 is a view similar to that of FIG. 6 but showing yet another wiper construction.

Referring now to FIG. 7, parts similar or identical to those in FIG. 6 are identically numbered. The strip **101*a* is the same as strip 101 but instead of being in the form of a loop it is in the form of a strip which is wound in a roll 130 on a shaft or reel 131 and is wound up as it is used as a roll 132 on a shaft or reel 133**. A motor (not shown) may be used to move the strip continuously or intermittently to present fresh segments of strip material to the containers.

Figure 8:
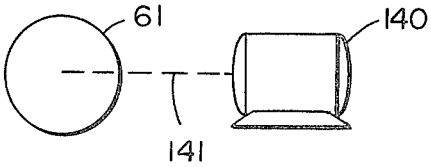
FIG. 8 is a schematic view showing a motor control for the applicator roller which applies plastic to the containers.

Referring now to FIG. 8, the applicator roller 61 may be driven by a motor 140 through a connection 141. The motor 140 may be a variable speed, reversible motor whereby the speed of roller 61 can be varied and its direction of rotation can be changed. By this means an extra degree of control can be exercized over the coating of containers.

It will therefore be apparent that a new and useful machine and method have been provided for the application of liquid coatings to plastic containers and the like.

I claim:

1. A machine for applying a liquid coating to cylindrical articles which comprises:

(a) a rotary shaft having an axis of rotation, (b) a plurality of pairs of chucks supported radially outwardly of said shaft for rotation with said shaft in an orbital path about the axis of said shaft, the chucks of each pair being in axial alignment and being free to rotate about their individual axes parallel to the axis of said shaft, each such pair of chucks being adapted to pick up a cylindrical article at a pickup point, to transport each article to a delivery point and to release the article at such delivery point, (c) chuck spinning means mounted on said shaft and free to rotate relatively thereto, said chuck spinning means engaging one of each pair of chucks as it rotates orbitally about the axis of said shaft to cause each such chuck to spin about its individual axis, said chuck spinning means also allowing reversal of the direction of spinning of the article, (d) means for rotating said chuck spinning means relatively to said shaft, and (e) applicator means in the form of a rotary member tangent to said cylindrical articles as they undergo orbital motion about the axis of said shaft.

2. A machine for applying a liquid coating to cylindrical articles which comprises:

(a) a rotary shaft having an axis of rotation, (b) a plurality of pairs of chucks supported radially outwardly of said shaft for rotation with said shaft in an orbital path about the axis of said shaft, the chucks of each pair being in axial alignment and being free to rotate about their individual axes parallel to the axis of said shaft, each such pair of chucks being adapted to pick up a cylindrical article at a pickup point, to transport each article to a delivery point and to release the article at such delivery point, (c) chuck spinning means mounted on said shaft and free to rotate relatively thereto, said chuck spinning means engaging one of each pair of chucks as it rotates orbitally about the axis of said shaft to cause each such chuck to spin about its individual axis, (d) means for rotating said chuck spinning means relatively to said shaft, (e) applicator means in the form of a rotary member tangent to said cylindrical articles as they undergo orbital motion about the axis of said shaft, and (f) wiper means between the applicator means and the delivery point, such wiper means acting to spread the liquid coating uniformly.

3. The machine of claim 2 including dryer means adjacent the transport between the wiper means and the delivery point, such dryer means serving to dry the applied coatings.

4. The machine of claim 2 wherein the wiper means is in the form of a resilient wiper member which is concentric to said shaft, is compressible and is located at a distance from the axis of said shaft such that a pressure is applied to the wiper by the containers as they are wiped.

5. The machine of claim 2 wherein the wiper is in the form of a strip of wiper material supported in relation to said shaft such that it is deformed by the containers as they pass by.

6. The machine of claim 5 wherein the strip of wiper material is in the form of a loop, and means are provided to advance the strip continuously or intermittently to bring fresh segments of the strip into contact with the containers.

7. The machine of claim 5 wherein the strip of wiper material is in the form of a supply roll thereof and the strip as it is used is wound up on a take-up reel.

8. The machine of claim 6 or claim 7 including adjustable tensioning means for adjusting tension of the strip of wiper material as containers pass by.

9. A machine for applying a liquid coating to cylindrical articles which comprises:

(a) a rotary shaft having an axis of rotation, (b) a plurality of pairs of chucks supported radially outwardly of said shaft for rotation with said shaft in an orbital path about the axis of said shaft, the chucks of each pair being in axial alignment and being free to rotate about their individual axes parallel to the axis of said shaft, each such pair of chucks being adapted to pick up a cylindrical article at a pickup point, to transport each article to a delivery point and to release the article at such delivery point, (c) chuck spinning means mounted on said shaft and free to rotate relatively thereto, said chuck spinning means engaging one of each pair of chucks as it rotates orbitally about the axis of said shaft to cause each such chuck to spin about its individual axis, (d) means for rotating said chuck spinning means relative to said shaft, and (e) applicator means including a vessel for holding a liquid coating material, a roller dipping into the liquid material in such vessel and in operative tangent contact with articles as they pass by, means for driving the roller, such means being adjustable as to speed and being reversible, and means for tilting the roller to adjust its position in relation to the articles.

10. A machine for applying a liquid coating to cylindrical articles which comprises:

(a) a rotary shaft having an axis of rotation, (b) a plurality of pairs of chucks supported radially outwardly of said shaft for rotation with said shaft in an orbital path about the axis of said shaft, the chucks of each pair being in axial alignment and being free to rotate about their individual axes parallel to the axis of said shaft, each such pair of chucks being adapted to pick up a cylindrical article at a pickup point, to transport each article to a delivery point and to release the article at such delivery point, (c) chuck spinning means in the form of first and second discs mounted coaxially of said shaft and free to rotate about the axis of the shaft, a variable drive for the first disc, the second disc being driven by the first disc and serving to spin one of each pair of chucks, (d) means for rotating said chuck spinning means relatively to said shaft, and (e) applicator means in the form of a rotary member tangent to said cylindrical articles as they undergo orbital motion about the axis of said shaft.

* * * * *